US009852677B2

(12) United States Patent
Zhang et al.

(10) Patent No.: US 9,852,677 B2
(45) Date of Patent: Dec. 26, 2017

(54) DITHERING FOR IMAGE DATA TO BE DISPLAYED

(71) Applicant: Intel Corporation, Santa Clara, CA (US)

(72) Inventors: Yanli Zhang, San Jose, CA (US); Seh Kwa, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 344 days.

(21) Appl. No.: 14/532,607

(22) Filed: Nov. 4, 2014

(65) Prior Publication Data

US 2016/0125788 A1 May 5, 2016

(51) Int. Cl.

| | |
|---|---|
| ***G08G 5/00*** | (2006.01) |
| ***G09G 3/20*** | (2006.01) |
| ***G09G 3/34*** | (2006.01) |

(52) U.S. Cl.

CPC ..... *G09G 3/2044* (2013.01); *G09G 3/3406* (2013.01); *G09G 2320/0646* (2013.01); *G09G 2340/0435* (2013.01)

(58) Field of Classification Search

CPC ..... G09G 3/346

See application file for complete search history.

(56) References Cited

U.S. PATENT DOCUMENTS

| | | | | |
|---|---|---|---|---|
| 6,678,406 | B1 * | 1/2004 | Mojsilovic | H04N 1/644 358/1.9 |
| 8,253,756 | B2 | 8/2012 | Lee et al. | |
| 8,407,921 | B2 | 4/2013 | Hu et al. | |
| 8,928,688 | B2 | 1/2015 | Hung | |
| 2008/0034238 | A1 * | 2/2008 | Hendry | G06F 1/3203 713/323 |
| 2009/0295706 | A1 | 12/2009 | Feng | |
| 2011/0187760 | A1 * | 8/2011 | Li | G09G 5/10 345/690 |
| 2011/0298789 | A1 | 12/2011 | Ko et al. | |
| 2012/0206461 | A1 | 8/2012 | Wyatt et al. | |
| 2012/0236021 | A1 | 9/2012 | Parmar et al. | |
| 2013/0011076 | A1 * | 1/2013 | Obzhirov | H04N 1/52 382/251 |
| 2013/0021352 | A1 | 1/2013 | Wyatt et al. | |

(Continued)

FOREIGN PATENT DOCUMENTS

| | | | |
|---|---|---|---|
| JP | 2014528653 | A | 10/2014 |
| TW | 201243789 | A | 11/2012 |

(Continued)

OTHER PUBLICATIONS

Taiwan IPO Search Report, Taiwan Application No. 104132160, dated Jul. 1, 2016, 2 pages.

(Continued)

*Primary Examiner* — Phi Hoang

(74) *Attorney, Agent, or Firm* — International IP Law Group, P.L.L.C.

(57) ABSTRACT

Techniques related to image dithering are described herein. The techniques include receiving an image to be displayed at a display device and entering a content adaptive backlight control mode. The image is dithered during the content adaptive backlight control mode. The dithering is disabled during a panel self-refresh mode.

25 Claims, 5 Drawing Sheets

(56) References Cited

U.S. PATENT DOCUMENTS

| | | | | |
|---|---|---|---|---|
| 2013/0093803 | A1* | 4/2013 | Saitoh | G09G 3/3611 345/690 |
| 2014/0118384 | A1 | 5/2014 | Buckley et al. | |
| 2015/0134985 | A1* | 5/2015 | Gopal | G06F 1/3265 713/320 |
| 2015/0154920 | A1* | 6/2015 | Buckley | G09G 3/3413 345/690 |
| 2015/0287354 | A1* | 10/2015 | Wang | G09G 3/2051 345/598 |
| 2015/0339994 | A1* | 11/2015 | Verbeure | G09G 3/2044 345/214 |
| 2016/0042707 | A1* | 2/2016 | Wang | G09G 3/2044 345/214 |

FOREIGN PATENT DOCUMENTS

| | | | |
|---|---|---|---|
| TW | 201246161 | A | 11/2012 |
| TW | I409793 | B | 9/2013 |
| TW | I438749 | B | 5/2014 |

OTHER PUBLICATIONS

PCT International Search Report, PCT Application No. PCT/US2015/053654, dated Feb. 24, 2016, 4 pages.

* cited by examiner

200

300

400

DITHERING FOR IMAGE DATA TO BE DISPLAYED

BACKGROUND ART

In computer graphics, an object may be rendered and provided to a display device. In some cases, image processing may be used to reduce power consumption of the display. For example, content adaptive backlight control (CABC) may be implemented. CABC may generally include modifying pixels of an image to be displayed such that some pixels may be enhanced while backlighting reduced such that a perceived brightness may be retained. Further, reduction of power consumption may be implemented through panel self-refresh (PSR) techniques. PSR techniques include reducing the number of frames provided from a graphics processing unit (GPU) to a display device when an image being displayed is static, or relatively unchanged in view of a predetermined threshold. In this case, the power reduction is generated since updates from the GPU are reduced, and the display may rely on image data stored on a memory unit of the display device. In some cases, CABC may include quantization wherein bit depths of an image are truncated before the image is provided to the display device. In some cases, if the image being provided to the display device includes a fine color gradient, boundary rolling may be perceived at the display device during the CABC processing. Boundary rolling may include a perceived ripple moving across an image being displayed.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

The subject matter disclosed herein relates to techniques for image dithering. As discussed above, in a content adaptive backlight control (CABC) mode, some pixels may be enhanced while a backlight for the image is reduced. The resulting perceived brightness may be the same or better than if the CABC mode was not implemented. The CABC mode may reduce power consumption as a result of the backlight reduction.

Once pixels have been enhanced to a bit depth, the bit depth may be truncated based on a maximum bit depth capability of a display device. For example, a given pixel may be mapped to a color having a bit depth of 10 bits. However, the display at which the image is to be displayed may only be capable of a bit depth value of 6. Therefore, the bit value of 10 may be truncated to a bit depth of 6. Implementing CABC mode may work for many images, but for some images having a high color gradient the truncation may cause a perceived boundary rolling effect on the displayed image.

Boundary rolling may include a perceived ripple moving across an image being displayed. A viewer may perceive the ripple when image content is displayed with a high color gradient based, in part, on the truncation of the CABC mode. In some cases, a high color gradient may be determined based on a threshold indicating a certain change in color across an image to be displayed.

The techniques described herein include dithering an image to be displayed during a content adaptive backlight control (CABC). Dithering refers to noise that is intentionally introduced to reduce a perceived boundary rolling effect. However, during a panel-self refresh (PSR) mode, image data may be compressed and stored in a memory of the display. Therefore, rather than providing dithered data to be potentially compressed and further distorted when uncompressed during PSR mode, the techniques described herein include disabling dithering during PSR mode.

The techniques described herein may be implemented in a computing device. For example, the techniques described herein may be implemented in a mobile computing device having a digital display interface, wherein the CABC and PSR mode save mobile display power, while reducing any boundary rolling effect.

Figure 1:
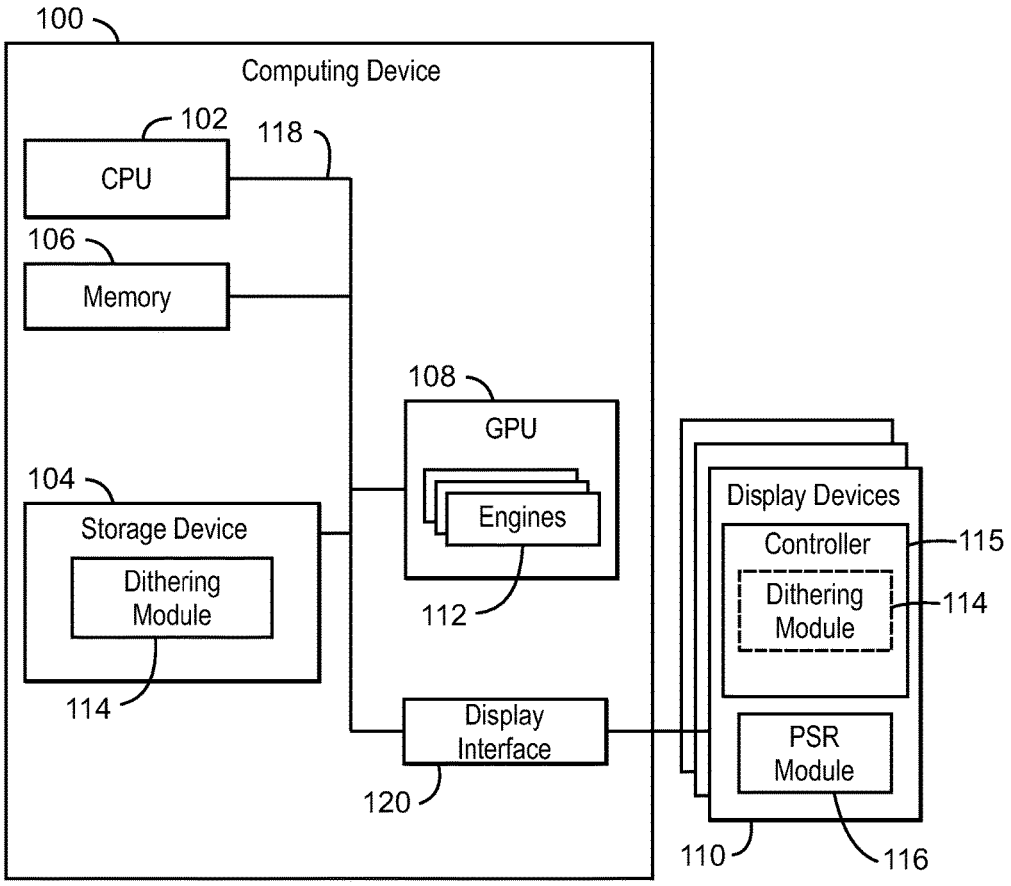
FIG. 1 is a block diagram illustrating a computing device configured to provide dithering of an image.

FIG. 1 is a block diagram illustrating a computing device configured to provide dithering of an image. The computing device 100 may be, for example, a laptop computer, desktop computer, ultrabook, tablet computer, mobile device, or server, among others. The computing device 100 may include a central processing unit (CPU) 102 that is configured to execute stored instructions, as well as a storage device 104 including a non-transitory computer-readable medium, and a memory device 106.

The computing device 100 may also include a graphics processing unit (GPU) 108. As shown, the CPU 102 may be coupled through the bus 106 to the GPU 108. In embodiments, the GPU 108 is embedded in the CPU 102. The GPU 108 may include a cache, and can be configured to perform any number of graphics operations within the computing device 100. For example, the GPU 108 may be configured to render or manipulate graphics images, graphics frames, videos, or the like, to be displayed to a user of the computing device 100 at one or more display devices 110. The GPU 108 includes plurality of engines 112.

In some cases, the engines 112 may be configured to perform dithering as directed by instructions of a dithering module 114. In some cases, the dithering module 114 may be implemented as logic, at least partially comprising hardware logic such as stored instructions configured to be carried out by the engines 112 of the GPU 108, stored instructions configured to be carried out by the CPU 102, electronic logic to be carried out by electronic circuitry, circuitry to be carried out by an integrated circuit, and the like. The dithering module 114 may be configured to operate independently, in parallel, distributed, or as a part of a broader process. In some cases, the dithering module 114 may be implemented as an operation of a controller 115 at one or more of the display devices 110, as indicated by the dashed box 114 in FIG. 1. The controller 115 may be a timing controller, and may be logic, at least partially including hardware logic, such as an integrated circuit, electronic circuitry logic, and the like.

In one example, the engines 112 may be configured to receive an image to be displayed at a display device, such as one of the display devices 110. The CABC mode may be entered by one or more of the display engines 112, and the dithering module 114 is configured to dither the image during the CABC mode, and disable dithering during a PSR mode. In embodiments, the CABC mode may include a phase-in period wherein the dithering is enabled during the phase-in period. The phase-in period may include pixel modification and backlight power adjustment. In some cases, the phase-in period may be associated with a timer. In this scenario, the dithering may continue until the timer expires for the phase-in period. Further, in some cases, the timer is reset if new image data is received, and the dithering may continue during the new phase-in period, as discussed below in FIG. 3. In any case, dithering may be disabled during a PSR mode carried out by a PSR module 116. The PSR module 116 may be stored instructions implemented at the display device 110. In some cases, the PSR module 116 may be stored instructions implemented at the GPU 108 by the engines 112.

The memory device 104 can include random access memory (RAM), read only memory (ROM), flash memory, or any other suitable memory systems. For example, the memory device 104 may include dynamic random access memory (DRAM).

The CPU 102 may be linked through a bus 118 to a display interface 120 configured to connect the computing device 100 to display devices 110 via a digital display interface. The display devices 116 may include a display screen that is a built-in component of the computing device 100. The display devices 110 may also include a computer monitor, television, or projector, among others, that is externally connected to the computing device 100.

In some cases, the computing device 100 may be a mobile computing device. In some cases, the display devices 110 may be mobile display devices of a mobile computing device. In these scenarios, the techniques described herein include power saving techniques for mobile display power.

The CPU 102 may be a main processor that is adapted to execute the stored instructions. The CPU 102 may be a single core processor, a multi-core processor, a computing cluster, or any number of other configurations. The CPU 102 may be implemented as Complex Instruction Set Computer (CISC) or Reduced Instruction Set Computer (RISC) processors, x86 Instruction set compatible processors, multi-core, or any other microprocessor or central processing unit (CPU).

The memory device 106 can include random access memory (RAM) (e.g., static random access memory (SRAM), dynamic random access memory (DRAM), zero capacitor RAM, Silicon-Oxide-Nitride-Oxide-Silicon SONOS, embedded DRAM, extended data out RAM, double data rate (DDR) RAM, resistive random access memory (RRAM), parameter random access memory (PRAM), etc.), read only memory (ROM) (e.g., Mask ROM, programmable read only memory (PROM), erasable programmable read only memory (EPROM), electrically erasable programmable read only memory (EEPROM), etc.), flash memory, or any other suitable memory systems. The CPU 102 may be connected through the system bus 118 (e.g., Peripheral Component Interconnect (PCI), Industry Standard Architecture (ISA), PCI-Express, HyperTransport®, NuBus, etc.) to components including the memory 106 and the storage device 104.

The block diagram of FIG. 1 is not intended to indicate that the computing device 100 is to include all of the components shown in FIG. 1. Further, the computing device 100 may include any number of additional components not shown in FIG. 1, depending on the details of the specific implementation.

Figure 2:
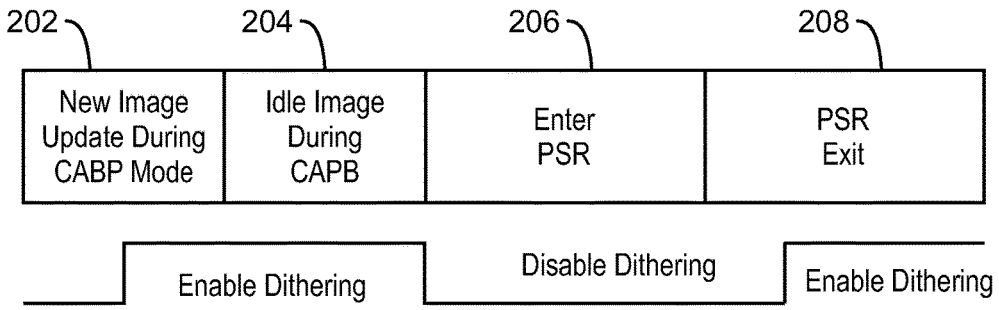
FIG. 2 is a diagram illustrating a timeline of when dithering is enabled.

FIG. 2 is a diagram illustrating a timeline of when dithering is enabled. As illustrated in FIG. 2, a new image update is received at 202. The image update may include image data that may or may not be altered based on CABC. In some cases, the image data may be idle image data during CABC phase-in, as indicated at 204. As illustrated in FIG. 2, dithering may be enabled during the CABC mode. At 208, a PSR mode may be entered.

In PSR mode, image data may potentially be compressed for storage at a display device, such as one or more of the display devices 110. During PSR mode, dithering may be disabled. Once PSR mode has been exited at 208, dithering may be enabled again.

Figure 3:
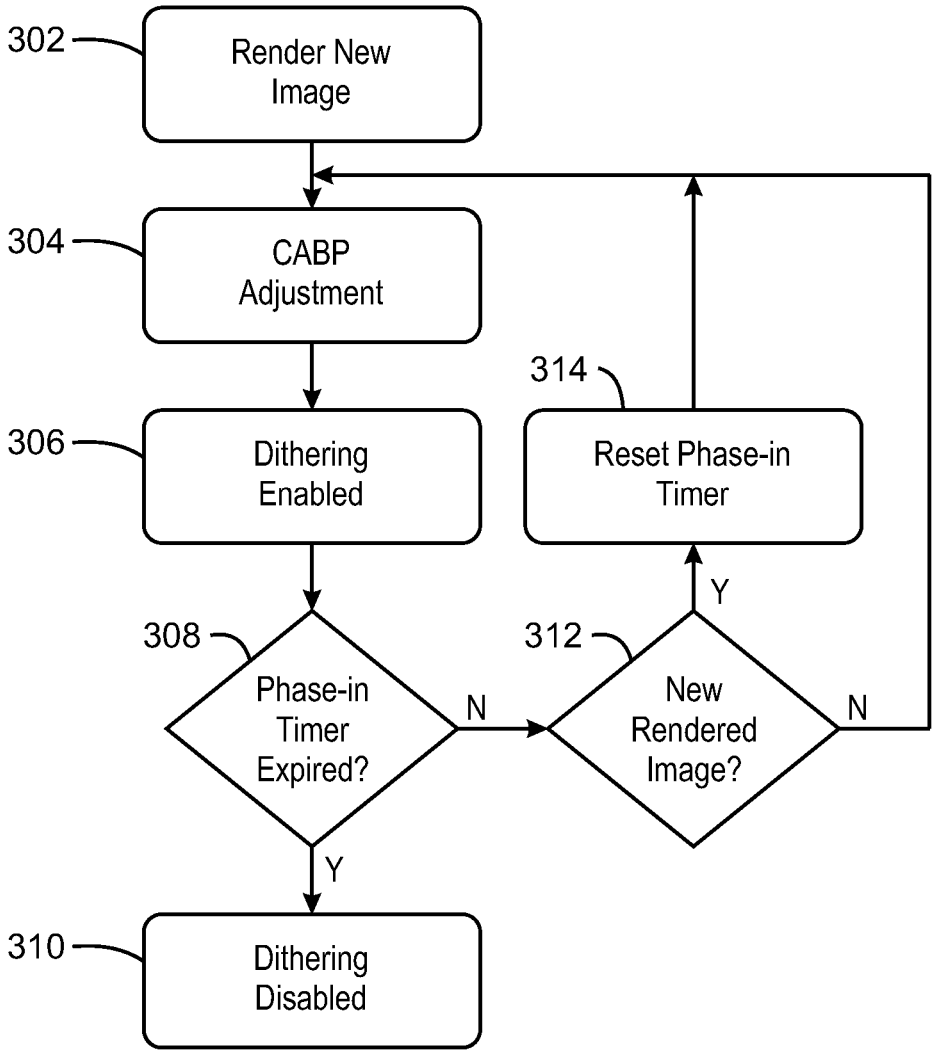
FIG. 3 is a process flow diagram of illustrating a process of enabling dithering.

FIG. 3 is a process flow diagram of illustrating a process of enabling dithering. At 302, a new image is rendered. CABC adjustment occurs at 304, and dithering is enabled at 306. CABC adjustment may include profiling a histogram associated with the new image. The histogram may determining whether content, such as a bit depth for any given content should be enhanced while dimming a backlight.

At 308, a determination is made as to whether a phase-in timer has expired. If the phase-in timer has expired, then dithering is disabled at 310. If the phase-in timer has not expired, then a determination is made as to whether new rendered images have been received at 310. If a new rendered image has not been received, the process continues with CABC adjustment at 304 with dithering enabled at 306. If a new rendered image has been received, the phase-in timer is reset at 314, and the process begins again at 304.

Figure 4:
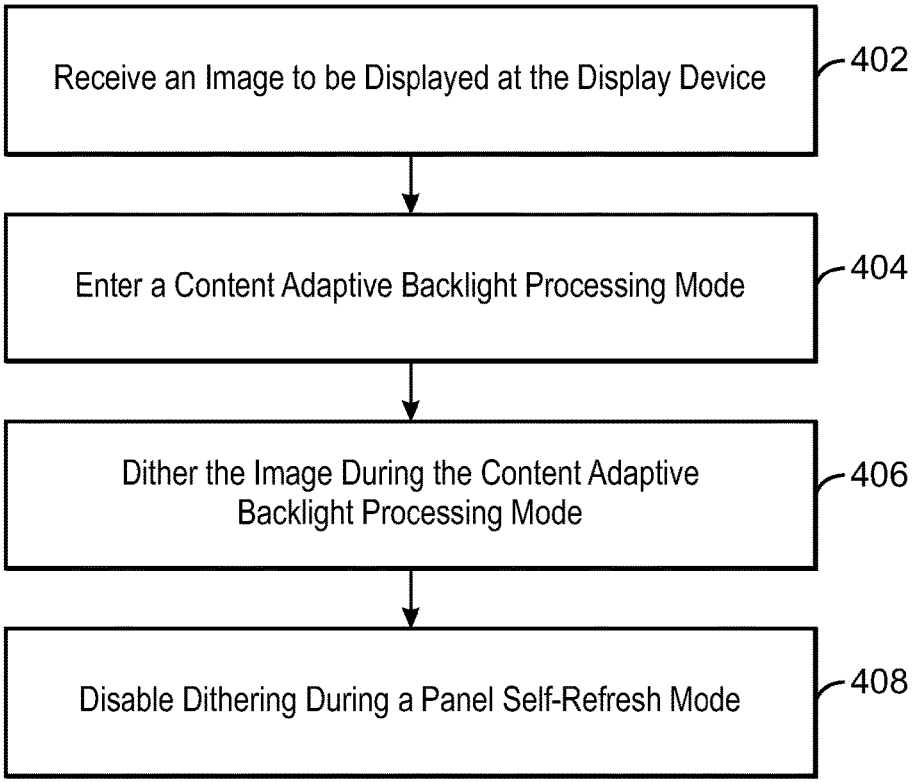
FIG. 4 is a block diagram illustrating a method for dithering images to be displayed.

FIG. 4 is a block diagram illustrating a method for dithering images to be displayed. At block 402, an image to be displayed is received. A CABC mode is entered at 404. The image is dithered during the CABC mode, as indicated at 406. However, during PSR mode, the dithering is disabled, as indicated at 408.

As discussed above, in some cases the method may include enabling dithering if a color gradient of the image to be displayed is above a predetermined threshold. Further, the dithering itself may include temporal dithering, spatial dithering, or any combination thereof. In yet further cases, dithering may be performed at a graphics processing unit, such as the GPU 108, rather than at a controller of a display device, such as one of the display devices 110.

Figure 5:
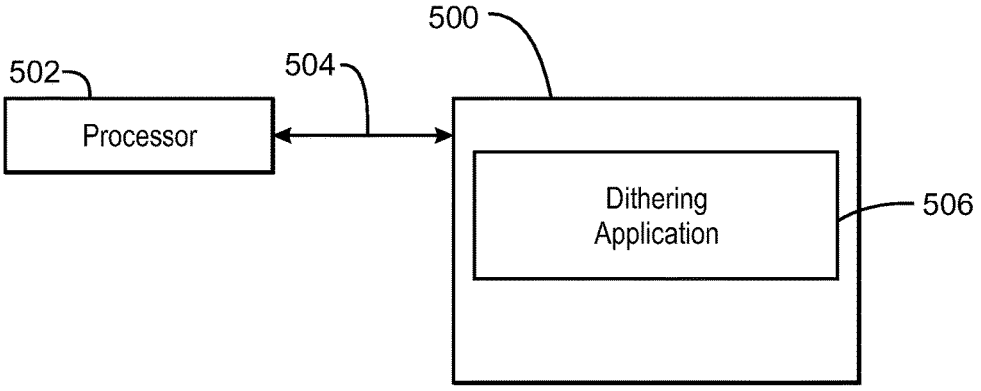
FIG. 5 is a block diagram depicting an example of a computer-readable medium configured to implement image dithering.

FIG. 5 is a block diagram depicting an example of a computer-readable medium configured to implement image dithering. The computer-readable medium 500 may be accessed by a processor 502 over a computer bus 504. In some examples, the computer-readable medium 500 may be a non-transitory computer-readable medium. In some examples, the computer-readable medium may be a storage medium, but not including carrier waves, signals, and the like. Furthermore, the computer-readable medium 500 may include computer-executable instructions to direct the processor 502 to perform the steps of the current method.

The various software components discussed herein may be stored on the tangible, non-transitory, computer-readable medium 500, as indicated in FIG. 5. For example, a dithering application 506 may be configured to receive an image to be displayed at the display device, and enter a content adaptive backlight control mode. The dithering application 506 may also be configured to dither the image during the content adaptive backlight control mode, and disable dithering during a panel self-refresh mode.

Examples may include subject matter such as a method, means for performing acts of the method, at least one machine-readable medium including instructions that, when performed by a machine cause the machine to performs acts of the method. It is to be understood that specifics in the aforementioned examples may be used anywhere in one or more embodiments. For instance, all optional features of the computing device described above may also be implemented with respect to either of the methods described herein or a computer-readable medium. Furthermore, although flow diagrams and/or state diagrams may have been used herein to describe embodiments, the present techniques are not limited to those diagrams or to corresponding descriptions herein. For example, flow need not move through each illustrated box or state or in exactly the same order as illustrated and described herein.

Example 1 includes a system for dithering images to be displayed. The system includes a display device, and a dithering module. The dithering module may include hardware logic, wherein the logic of the dithering module is to receive an image to be displayed at the display device, and enter a content adaptive backlight control mode. The dithering module is further configures to dither the image during the content adaptive backlight control mode, and disable dithering during a panel self-refresh mode.

Example 2 includes a method for dithering images to be displayed. The method includes receiving an image to be displayed at a display device, and entering a content adaptive backlight control mode. Dithering is enabled during the content adaptive backlight control mode and disabled during a panel self-refresh mode. In some cases, a tangible, non-transitory, computer-readable medium comprises code to carry out the method of Example 2.

Example 3 includes a tangible, non-transitory, computer-readable medium comprising code to direct a processor to perform operations. The operations include receiving an image to be displayed at a display device, and entering a content adaptive backlight control mode. Dithering is enabled during the content adaptive backlight control mode and disabled during a panel self-refresh mode.

Example 4 includes an apparatus for image dithering. The apparatus includes a means to receive an image to be displayed at a display device, and enter a content adaptive backlight control mode. The means is also configured to dither the image during the content adaptive backlight control mode, and disable dithering during a panel self-refresh mode. In embodiments, the means is processor executable code. In some cases, the means may be some combination of firmware, hardware logic, electronic circuitry, and the like.

Example 5 includes a system for image dithering. The system includes a display device, a storage device to store instructions, and a processing device that, when executed by the stored instructions, is configured to receive an image to be displayed at the display device, enter a content adaptive backlight control mode. The stored instructions may direct the processor to dither the image during the content adaptive backlight control mode and disable dithering during a panel self-refresh mode.

In the above description and the following claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices.

An embodiment is an implementation or example. Reference in the present specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A system for dithering images to be displayed, comprising:

a display device; and a dithering module, at least partially comprising hardware logic, wherein the logic of the dithering module is to:
receive an image to be displayed at the display device;
enter a content adaptive backlight control mode;
dither the image during the content adaptive backlight control mode in response to a truncation of bit depth in the content adaptive backlight control mode; and
disable dithering during a panel self-refresh mode.

2. The system of claim 1, wherein the content adaptive backlight control mode comprises operations comprising one or more of:
pixel content modification for one or more pixels; and
backlight power adjustment for one or more pixels.

3. The system of claim 2, wherein the content adaptive backlight control mode comprises a phase-in period wherein pixel content modification and backlight adjustment is performed.

4. The system of claim 3, wherein the dithering is performed during the phase-in period of the content adaptive backlight control mode.

5. The system of claim 4, wherein the dithering module is further configured to:
start a timer associated with the phase-in period;
enable dithering;
determine whether a new image to be displayed is received;
restart the timer if the new image is received; and
continue dithering if the new image has not been received until the timer expires.

6. The system of claim 1, wherein during the panel self-refresh mode the dithering module is to reduce updates provided by a graphics processing unit to the display device while the image being displayed is unchanged.

7. The system of claim 1, wherein dithering is enabled when the image comprises a color gradient above a predetermined threshold.

8. The system of claim 1, wherein dithering comprises:
temporal dithering;
spatial dithering; or
any combination thereof.

9. The system of claim 1, wherein the dithering module comprises instructions to be carried out by a processor, wherein the processor is a graphics processing unit, and wherein the dithering is performed at the graphics processing unit and not at a controller of the display device.

10. The system of claim 1, wherein the dithering module is to reduce a perceived rolling effect based on the dithering performed.

11. A method for dithering images to be displayed, comprising:
receiving an image to be displayed at a display device;
entering a content adaptive backlight control mode;
dithering the image during the content adaptive backlight control mode in response to a truncation of bit depth of the image with a fine color gradient in the content adaptive backlight control mode; and
disabling dithering during a panel self-refresh mode.

12. The method of claim 11, wherein the content adaptive backlight control mode comprises one or more of:
pixel content modification for one or more pixels; and
adjusting backlight power for one or more pixels.

13. The method of claim 12, wherein the content adaptive backlight control mode comprises a phase-in period wherein pixel content modification and backlight adjustment is performed.

14. The method of claim 13, wherein the dithering is performed during the phase-in period of the content adaptive backlight control mode.

15. The method of claim 14, further comprising:
starting a timer associated with the phase-in period;
enabling dithering;
determining whether a new image to be displayed is received;
restarting the timer if the new image is received; and
continuing dithering if the new image has not been received until the timer expires.

16. The method of claim 11, wherein the panel self-refresh mode comprises reducing updates provided by a graphics processing unit to the display device while the image being displayed is unchanged.

17. The method of claim 11, wherein dithering is enabled when the image comprises a color gradient above a predetermined threshold.

18. The method of claim 11, wherein dithering comprises:
temporal dithering;
spatial dithering; or
any combination thereof.

19. The method of claim 11, wherein the dithering is performed at a graphics processing unit of a computing device.

20. The method of claim 11, further comprising reducing a perceived rolling effect based on the dithering performed.

21. A tangible, non-transitory, computer-readable medium comprising code to direct a processor to:
receive an image to be displayed at the display device;
enter a content adaptive backlight control mode;
dither the image during the content adaptive backlight control mode in response to a truncation of bit depth in the content adaptive backlight control mode; and
disable dithering during a panel self-refresh mode.

22. The computer-readable medium of claim 21, wherein the content adaptive backlight control mode comprises operations comprising one or more of:
pixel content modification for one or more pixels; and
backlight power adjustment for one or more pixels.

23. The computer-readable medium of claim 22, wherein the content adaptive backlight control mode comprises a phase-in period wherein pixel content modification and backlight adjustment is performed, and wherein the dithering is performed during the phase-in period of the content adaptive backlight control mode.

24. The computer-readable medium of claim 21, wherein during the panel self-refresh mode the code to direct the processor to reduce updates provided by a graphics processing unit to the display device while the image being displayed is unchanged.

25. The computer-readable medium of claim 21, wherein dithering is enabled when the image comprises a color gradient above a predetermined threshold, and wherein dithering comprises:
temporal dithering;
spatial dithering; or
any combination thereof.

* * * * *